United States Patent [19]

Mason et al.

[11] 3,982,046

[45] Sept. 21, 1976

[54] INCANDESCENT LAMPS

[75] Inventors: David Robert Mason; Susan Margaret Cole, both of Runcorn; John Michael Rees; James Richard Coaton, both of London, all of England

[73] Assignee: Thorn Lighting Limited, London, England

[22] Filed: Apr. 3, 1975

[21] Appl. No.: 564,768

Related U.S. Application Data

[62] Division of Ser. No. 434,381, Jan. 18, 1974, Pat. No. 3,902,091.

[30] Foreign Application Priority Data

Jan. 19, 1973 United Kingdom ..... 2952/73

[52] U.S. Cl. ..... 427/106; 427/107; 427/111; 313/221

[51] Int. Cl.[2] ..... H01K 1/32

[58] Field of Search ..... 427/106, 107, 111; 313/221, 222, 258, 116

[56] References Cited

UNITED STATES PATENTS

| | | | |
|---|---|---|---|
| 2,039,773 | 5/1936 | Braselton | 427/111 |
| 2,069,713 | 2/1937 | Braselton | 427/111 |
| 2,843,504 | 7/1958 | Bakel et al. | 427/106 |
| 3,902,091 | 8/1975 | Mason et al. | 313/221 |

*Primary Examiner*—Ralph S. Kendall
*Assistant Examiner*—Edith R. Buffalow
*Attorney, Agent, or Firm*—Robert F. O'Connell

[57] ABSTRACT

Tungsten-halogen lamps of extended life are obtained by coating internal surfaces of the discharge tube and exposed surfaces of internal components with metal phosphate or arsenate glasses. The preferred glass is aluminium titanium phosphate. The coatings may be formed by applying a liquid composition capable of generating the desired phosphate or arsenate to the surfaces to be coated, and subsequently heating them to remove the liquid medium and form a vitreous coating. The medium may be water or an organic solvent such as an alcohol, and may contain a dissolved compound of the metal and an oxyacid of phosphorus or arsenic.

7 Claims, 1 Drawing Figure

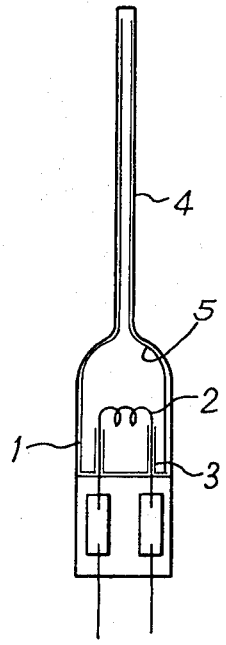
4
5
2
1
3

INCANDESCENT LAMPS

This is a division of application Ser. No. 434,381, filed on Jan. 18, 1974, now U.S. Pat. No. 3,902,091.

This invention relates to electric incandescent lamps, and more especially to lamps operating by a tungsten-halogen cycle.

In any incandescent tungsten filament lamp containing a reactive fill such as halogen or halide, the choice of material for the internal components and envelope is usually very restricted. For lamps having iodine, bromine or chlorine in the fill the envelope is preferably fused quartz or a high silica content glass and the lead-in wire, filament supports, internal reflectors, shields and other internal components are substantially composed of molybdenum or tungsten. If less expensive, common materials such as nickel, iron, copper, aluminium and alloys containing these are used they react with the halogens to form halides which can cause filament embrittlement, and/or a halogen deficiency, both resulting in severely reduced filament life. Also, if soft glass, such as soda lime silicate, is used for the envelope, apart from the obvious difficulties of the low softening temperature and high water content, the alkali metals can react with the halogen or halides, again reducing filament life.

In operation, tungsten-halogen lamps normally contain a non-reactive gas filling such as $N_2$, Ar, Kr or Xe together with iodine, bromine or chlorine vapour which combines with the evaporated tungsten escaping from the incandescent filament. An equilibrium concentration is attained by the gaseous species within the lamp between the temperature limits defined by the incandescent filament and coldest spot on the lamp envelope. The cold spot temperature must be sufficiently high to prevent any tungsten halide from condensing, and provided that this condition is met a continuous tungsten transport cycle operates which keeps the envelope free from tungsten. The minimum envelope temperature depends upon the halogen or halogens taking part in the cycle. However, the maximum envelope temperature is usually well above the acceptable limit for soft glass, and for this reason tungsten-halogen lamp envelopes are usually made from vitreous fused silica or high silica content glasses.

The return of tungsten to the filament does not in itself increase filament life since tungsten iodides, bromides and chlorides dissociate well below normal filament operating temperatures. Radio-chemical tracers have shown that evaporated tungsten is redistributed during the life of the lamp so that the cooler parts of the filament collect tungsten at a greater rate than the hotter parts. Filament failure usually occurs quite normally by the subsequent burn-out of a 'hot spot'. The improvement in life of tungsten-halogen lamps in comparison with conventional incandescent lamps is for quite a different reason. The absence of envelope blackening coupled with the requirement for a well-defined minimum envelope temperature dictates that the envelope must be substantially smaller than that of a conventional counterpart. In fact, tungsten-halogen lamp envelopes are usually small and mechanically strong and in consequence can be safely gas-filled to several atmospheres pressure. This increased gas filling pressure accounts for the gain in life.

If filament hot spots could be healed or prevented a further extension in filament life would be possible.

This is feasible with a tungsten-fluorine transport cycle because in this case the most stable tungsten fluoride dissociates at a temperature above 3000°C, and tungsten is returned to the incandescent filament surface. Again, this has been substantiated by radiochemical tracer experiments, which show that tungsten vapour returned from the region of the envelope is evenly distributed along the incandescent part of the filament. Technological difficulties have prevented the further development of tungsten-fluorine lamps, the principal problem being that free fluorine reacts rapidly with solid tungsten below about 2000°C, the cold parts of the filament, the lead wires and the supports being rapidly eroded, and that the fluorides formed (e.g. tungsten fluorides) react with the silica contained in the envelope material to form $SiF_4$, depositing tungsten on the tube wall. This uses up the free fluorine in a very short time. Various methods have been proposed for protecting the envelope and tungsten components but these have been unsuccessful because of the inability to produce a continuous thin layer of protective material free from pin-holes and minor defects.

The present invention seeks to provide a protective layer for the exposed internal surfaces of incandescent lamps which tend to react with the fill in the lamp envelope, particularly where this includes a halogen, and more especially fluorine or a fluorine-containing compound.

In lamps according to this invention, at least those portions of the internal surface of the envelope and the exposed surfaces of internal components which tend to react with the fill in the envelope during operation of the lamp are provided with a coating of a metal phosphate or arsenate glass composition. The surface to be covered may include the internal surface of the envelope, the filament tails or lead-in wires or the filament supports, depending on the nature of the fill gas employed and on the materials from which the envelope and the internal components are fabricated. Part or all of the filament or filaments may be initially provided with a coating according to the invention, for example where the coating technique cannot conveniently avoid this, but the coating on the filament will be removed when the filament is heated to incandescence.

The protective coatings provided in accordance with this invention may be applied to conventional materials used for the fabrication of lamp components, for example to protect them from highly reactive fill substances, or they may enable cheaper and more readily available materials to be substituted for conventionally used materials without unacceptable loss in performance or life.

The coating is preferably derived from an aluminium phosphate complex as described in German Offenlegungschrift (DOS) No. 2,028,839 (British Patents Nos. 1,322,722 and 1,322,729) or from one or more of the metal phosphate or arsenate compositions prepared in accordance with DOS No. 2,235,651 or from a composition comprising an aluminium phosphate and containing a titanium compound prepared in accordance with DOS No. 2,351,954, the latter being at present most preferred. Combinations of these compositions can also be used.

For the purposes of this invention, preferred metal phosphates and arsenates are those of atomic number 12 to 14, 20 to 32, 39 to 50, 56 to 80, 90 or 92. The term 'phosphate' is here meant to include ortho-, meta- and pyro-phosphates together with phosphinates and phosphonates.

Especially preferred sources of metal phosphate coatings are solvent-soluble complex phosphates containing co-ordinated solvent groups, such as water or polar organic solvents, as described in DOS Nos. 2,028,839 and 2,235,651. Not only are the isolated complex phosphates themselves suitable, but the compositions which are therein described containing phosphate precursors may also be used.

Liquid coating compositions may be used which comprise a solution, of (a) a metal compound and (b) an oxyacid of phosphorus or arsenic, or a compound capable of forming such an oxyacid in the solution. At least part of the solvent may be organic. These compositions are capable of decomposing to a metal phosphate or arsenate on being heated.

The solvent is selected from water or the wide range of organic solvents which dissolve the components of the composition. The organic solvent, when used, is preferably selected from alcohols, esters, ketones, aldehydes, nitro-compounds and ethers, especially monohydric alcohols of the structure ROH, esters of the structure $R^1COOR^2$, ethers of the structure $R^1OR^2$, ketones of the structure $R^1COR^2$, nitro-compounds of the structure $R^1NO_2$ and ethers of the structure $OR^3$, where R, $R^1$ and $R^2$ are alkyl groups or substituted alkyl groups containing from 1 to 10 carbon atoms each, and $R^3$ is a divalent alkyl group having from 4 to 7 carbon atoms one of which may be replaced by an oxygen atom. Mixtures of one or more solvents may be used. Diluents may also be present, provided they do not bring about precipitation of the components of the composition.

Aliphatic alcohols containing 1 to 10 carbon atoms are particularly convenient, especially lower molecular weight alcohols containing 1 to 4 carbon atoms, for example methanol, ethanol, n- or iso-propanol and substituted alcohols especially methoxy- or ethoxyethanol. Suitable esters are ethyl acetate or carbonate. Acetyl acetone may be used. Tetrahydrofuran is the most preferred ether to use, though dioxan may also be used. Aromatic hydroxy compounds can be used, but solubility is low in such materials.

The composition may be formed by dissolving an isolated complex of the type described in the specifications referred to above in a solvent. The metal compound may itself be a phosphate and so provide the oxyacid of phosphorus or arsenic, in which case in additional acid may be required to form a homogeneous solution, e.g. hydrochloric or nitric acid.

A wide range of metal compounds may be used. Simple inorganic compounds including oxides and hydroxides are suitable, as are salts such as halides, carbonates, nitrates, phosphates, perchlorates and cyanates. Sulphates may be used in some cases but they can be disadvantageous owing to the difficulty with which they are thermally decomposed.

Also suitable are salts of organic acids such as acetates, benzoates, oxalates, propionates or formates. Alkoxides are also useful.

Alternatively, co-ordination complexes of the metal may be used, for example complexes having ligands derived from acetylacetone, ethylenedithiol, ethanolamine, carbon monoxide or phosphines.

Preferred compositions are those in which the metal and oxyacid are present with atomic ratios of metal to phosphorus or arsenic from 1:0.1 to 1:2.9. Preferred metals are aluminium, iron, chromium, titanium vanadium and tin. Outstanding results have been achieved with this invention using compositions containing both aluminium and titanium.

A solvent-soluble aluminium phosphate may be used, for example the acid orthophosphates $Al_2(HPO_4)_3$ and $Al(H_2PO_4)_3$, and mixtures containing them.

Normal aluminium orthophosphate is insoluble in water but soluble in dilute mineral acids (for example hydrochloric and nitric acids) and in some carboxylic acids (for example citric acid) and such solutions may be used for the purpose of this invention. Moreover, solid complex aluminium phosphates containing the anion of the acid and chemically-bound water or alcohol (or a mixture thereof) may also be used.

Where the complex contains an alcohol group, it is preferred that it be an aliphatic alcohol containing from one to four carbon atoms, for example methyl alcohol, ethyl alcohol, n-propyl alcohol or isopropyl alcohol, although complexes with higher alcohols are known and may be used if desired.

The complex phosphates most commonly contain from three to five molecules of the hydroxy compound per phosphorus atom, for example water-containing complexes may have an empirical formula corresponding to $AlPO_4.HCl.(H_2O)_x$ where $x$ is in the range 3 to 5.

The complex aluminium phosphates containing alcohol and their solutions may be prepared by reacting aluminium compound, preferably halide, with an alcohol and phosphoric acid. One such compound has the empirical formula Al P Cl $H_{25}C_8O_8$.

The complex phosphate containing water can be made as above or by hydrolysing the alcohol-containing complex phosphates or, for example, by contacting aluminium phosphate hydrate with gaseous hydrogen chloride.

Iron, chromium, vanadium tin and titanium phosphate containing coatings may be prepared by dissolving a salt, preferably a halide, in an alcohol and adding phosphoric acid or a source thereof.

The glass layer should be free from pin-holes or other defect or imperfection which might cause it to break down during operation of the lamp. In one preferred method of making lamps according to this invention, the desired portions of the internal surface of the envelope and the surfaces of internal components which are exposed in the finished lamp are coated either separately or after assembly with a liquid composition capable of generating the desired metal phosphate or arsenate, and subsequently heated to evaporate the solvent and cure the composition to form a defect-free metal phosphate or arsenate coating. It has been found valuable in the production of defect-free coatings to allow the applied liquid coating composition to drain thoroughly and thereafter to bake initially at a relatively low temperature to remove the solvent and subsequently at a controlled higher temperature to complete the formation of the protective coating. The preferred baking temperatures vary with the particular composition of coating material employed, but can be determined by experiment.

One example of this technique, will now be described with reference to the accompanying drawing, which shows diagrammatically a tungsten-halogen lamp assembly in the course of manufacture.

As shown in the drawing, a 12V. 55W. tungsten-halogen lamp, of the type commonly used in projector and motor vehicle lighting applications, comprises a fused quartz envelope 1 in which is sealed a tungsten filament 2 supported on filament tails or lead-in wires 3 and is provided with an exhaust tube 4. The lamp is to be provided with a metal phosphate glass barrier layer covering the inside surface of the envelope 1, the filament 2 and filament tails 3.

A liquid coating composition containing the metal phosphate or arsenate is dispensed from a hypodermic syringe through the lamp exhaust tube 4 by inserting the needle of the syringe, discharging the liquid composition and then almost immediately drawing it back into the syringe, leaving only a thin layer adhering to the inside surfaces of the lamp structure. At this stage the lamp is inverted to drain, and then heated in a vacuum or suitably inert atmosphere, for example at approximately 100°C for an hour in the case of a methanolic composition. The metal phosphate glass coating is finally formed by baking at a higher temperature, for example at 300°–500°C in a vacuum or suitably-inert atmosphere for about 3 minutes in the case of an aluminium titanium phosphate composition. The final bake can be effectively incorporated in subsequent lamp processing.

The initial heating cycle is chosen to substantially remove the solvent and the time, temperature and atmosphere will depend upon the solvent selected. The temperature of the subsequent bake depends on the particular formulation used, but will in general be below 1000°C.

The lamp is then processed in the normal manner for tungsten-halogen lamps. When the filament is first energised the metal phosphate glass layer on the incandescent filament surface and part of the filament tail adjacent to the filament is removed, leaving a protective barrier on the envelope surface and cold parts of the filament tails or lead-in wires.

In accordance with one aspect of this invention it has been found that when such lamps are provided with a fluorine-containing fill they can be operated with less or even substantially no attack on the filament tails, the filament or the envelope surface by fluorine or fluorides. The fluorine can be added as the element, or more conveniently as $WF_6$ within the pressure range of 1 to 10 Torr, or as $NF_3$ or a solid such as $NF_4SbF_6$, $NF_4AsF_6$, $XeF_4SbF_6$, $XeF_4AsF_6$, $TeF_4SbF_5$, or $SeF_4SbF_5$. Solids may also be added in solution in suitable solvents as disclosed in the specification of our British Patent No. 1236174.

In accordance with another aspect to this invention, cheaper or more easily obtainable or workable materials are used for the envelope or internal components of tungsten-halogen lamps by providing on the exposed surfaces of such parts of the structure a coating of a metal phosphate or arsenate glass as described above.

In certain established tungsten-halogen lamps (e.g. twin filament car lamps) a molybdenum frame or wires is or are used both as lead-in conductors and as a member to carry a molybdenum (or tungsten) shield. There is some evidence to suggest that there is a limited chemical reaction between these components and the fill, and in such a case it is advantageous to coat them with a halogen- or halide-resistant layer of the phosphate or arsenate glass. However, as an alternative, the refractory metal in these components can be replaced by a less expensive and easier to work metal, such as iron or nickel, coated with one of the aforementioned glasses.

A further possibility is to use a glass envelope coated with a halogen- or halide-resistant layer of phosphate or arsenate glass in place of the fused quartz conventionally employed for such envelopes. This may involve a direct replacement of fused quartz by a hard glass, such as borosilicate or aluminosilicate, or the use of inexpensive soda-lime silicate soft glass. In the latter case the envelope dimensions should be carefully chosen so that the hottest part is below the glass strain temperature and the coldest part is above the well-established minimum for the particular tungsten-halogen cycle to function. This also would reduce material and manufacturing costs. It should be noted that aluminosilicate glass is used for the envelope material of certain tungsten-halogen lamps but cannot be considered as a replacement for fused quartz. It will thus be apparent that individual components or all the internal surfaces within the lamp may be coated.

The following are specific examples of the practical application of the present invention and in the production of tungsten-fluorine lamps.

EXAMPLE 1

A liquid aluminium titanium phosphate coating composition was prepared by dissolving anhydrous aluminium chloride (1.946 g.) in methanol (992.467 g.) and pouring the solution into titanium tetrachloride (3.961 g.). Orthophosphoric acid (1.626 g.) was added to the resultant solution.

A tungsten filament lamp assembly was coated internally with this composition by the technique described above and the coated assembly thoroughly drained, heated at 100°C in vacuo for 1 hour, and baked at 400°C for 3 minutes also in vacuo. The lamp was subsequently filled with 3½ atm. argon and 4 Torr $WF_6$ and finished in the usual way.

In operation, the lamp was successfully run at a filament temperature of 3000°C for 25 hours, and the failure at that time was not due to a breakdown of the coating. In contrast, similar lamps without the coating of this invention showed extremely rapid loss of fluorine due to reaction with the lamp components and had a life which in no case exceeded 2–3 minutes.

EXAMPLE 2

Lamps were made as described in Example 1 except that a gas filling of 3½ atm. pressure of nitrogen and 5 Torr of $NF_3$ was used. The reduced activity of this system, coupled with the protective coating, enabled lives of 150 hours to be achieved and, again, the coating had not broken down at the end of life.

EXAMPLE 3

A series of tungsten-fluorine lamps were prepared as described in Example 1 but using the coating formulations set out below and gas fills of 3½ atm. argon and 4 Torr $WF_6$. The coated assemblies were baked at 100°C in vacuo for 1 hour and subsequently at 200°–600°C for 3 minutes in vacuo.

The coating compositions were prepared from the following components in a similar manner to that described in Example 1, all percentages being by weight:

| | A | B | C |
|---|---|---|---|
| Anhydrous aluminium chloride (g.) | 0.77785 | 0.7785 | 0.7785 |
| Methanol (g.) | 397 | 398 | 395 |
| Titanium tetrachloride (g.) | 1.5842 | 0.7921 | 3.169 |

-continued

| | A | B | C |
|---|---|---|---|
| Orthophosphoric acid, 88% (g.) | 0.6503 | 0.6503 | 0.6503 |
| Content of aluminium phosphate complex with four methanol ligands (%, calc.) | 0.42 | 0.42 | 0.42 |
| Content of titanium (%, calc.) | 0.10 | 0.05 | 0.20 |

Formulation A is identical in composition to that used in Example 1, while B and C have respectively half and twice the titanium concentration.

With a final bake at 400°C in vacuo all three formulations gave lamps with a life of about 25 hours. Variation of the baking temperature had less effect in the case of formulation C (0.2% Ti) than in the other cases, and equally good results were obtained over the range 300°to 500°C.

Instead of aluminium titanium phosphate compositions described in the above preferred examples, aluminium phosphate coatings may be used, prepared from solutions of halogen-containing complex phosphates of aluminium as disclosed in DOS No. 2,028,839, coating the internal lamp surfaces, and heating to cure the coating under the conditions substantially as disclosed in the same Application.

EXAMPLE 4

Tungsten-fluorine lamps were prepared as described in Example 1, except that the coating compositions employed were aluminium phosphate compositions (without titanium) as described in DOS No. 2,028,839.

Using the heating and baking conditions of Example 1, which are especially suited to the aluminium titanium phosphate composition, the lamps coated with aluminium phosphate were found to have a useful life of about 15 minutes, after which time they showed evidence of loss of fluorine and attack on the structure by fluorine and fluorides. Although the coatings employed in this example gave the lamps much less protection than the coating of Example 1, the life of the lamps was nevertheless notably greater than the life of uncoated lamps.

Instead of one of the above compositions, coatings may be used prepared from liquid compositions of other metal compounds and oxyacids of phosphorus or arsenic as disclosed in DOS No. 2,235,651 and the other Applications listed with it above, coating the internal lamp surfaces and heating under the conditions substantially as disclosed in the same Applications, the remainder of the processing following the same general lines as in the above preferred examples.

It should be noted that it is not an essential part of the process of this invention to coat the envelope and internal components after assembly, as described in the above preferred examples, and individual components may be coated before lamp assembly. The essential feature of the invention is the provision of a continuous layer consisting essentially of a metal phosphate or arsenate glass covering the interior surface of the envelope or any internal components that could react with halogen or tungsten halides at the lamp operating temperatures.

What we claim is:

1. In the method of making a tungsten-halogen lamp comprising a light-transmitting envelope, internal components including a tungsten filament and supports thereof sealed within said envelope and a gaseous fill including halogen in said envelope, the improvement comprising the steps of:

coating at least those portions of the internal surface of the envelope and the exposed surfaces of said internal components, which tend to react with halogen during operation of the lamp, with a solution having dissolved therein a composition selected from metal phosphates and arsenates, said solution being capable of generating on being heated a potentially vitreous compound;

and heating said surfaces to form thereon a vitreous coating of said metal phosphate or arsenate.

2. The method of claim 1 wherein the coating step includes the steps of:

applying said solution to said surfaces; and allowing said composition to drain from said surfaces to leave a substantially uniform coating therein; and the heating step includes the steps of initially heating said uniformly coated surfaces to remove said liquid medium;

and subsequently baking said surfaces at a controlled higher temperature to complete the formation of said vitreous coating.

3. The method of claim 2 wherein said solution contains a solvent soluble complex phosphate containing coordinated solvent groups.

4. The method of claim 2 wherein said solution has dissolved therein a compound of said metal and an acid moiety selected from oxyacids of phosphorus and arsenic and compounds capable of forming such oxyacids in the solution.

5. The method of claim 2 wherein said solution comprises a solvent selected from water, alcohols, esters, ketones, aldehydes, nitro-compounds and ethers.

6. The method of claim 2 wherein said vitreous coating is aluminium titanium phosphate.

7. The method of claim 1 wherein the atomic ratio of metal to phosphorus or arsenic in the vitreous coating is from 1:0.1 to 1:2.9.

* * * * *